US011444399B2

(12) United States Patent
Sabo et al.

(10) Patent No.: US 11,444,399 B2
(45) Date of Patent: Sep. 13, 2022

(54) HIGH RELIABILITY SLIDING POWER CONNECTOR

(71) Applicant: FCI USA LLC, Etters, PA (US)

(72) Inventors: James M. Sabo, Marysville, PA (US); Clarence Randall Fry, Mount Holly Springs, PA (US)

(73) Assignee: FCI USA LLC, Etters, PA (US)

( * ) Notice: Subject to any disclaimer, the term of this patent is extended or adjusted under 35 U.S.C. 154(b) by 0 days.

(21) Appl. No.: 16/656,068

(22) Filed: Oct. 17, 2019

(65) Prior Publication Data

US 2020/0127403 A1 Apr. 23, 2020

Related U.S. Application Data

(60) Provisional application No. 62/747,546, filed on Oct. 18, 2018.

(51) Int. Cl.
*H01R 12/72* (2011.01)
*H01R 12/70* (2011.01)
(Continued)

(52) U.S. Cl.
CPC ..... *H01R 12/721* (2013.01); *H01R 12/7005* (2013.01); *H01R 12/716* (2013.01);
(Continued)

(58) Field of Classification Search
CPC .. H01R 12/721; H01R 12/7005; H01R 43/20; H01R 13/2442; H01R 43/26;
(Continued)

(56) References Cited

U.S. PATENT DOCUMENTS 5,807,120 A 9/1998 Matthews
5,830,018 A * 11/1998 Simmel ..... H01R 12/716 439/660
(Continued)

FOREIGN PATENT DOCUMENTS

CN 206148685 U 5/2017

OTHER PUBLICATIONS

Sabo et al., Low Cost, High Reliability Sliding Power Connector, U.S. Appl. No. 16/656,016, filed Oct. 17, 2019.

*Primary Examiner* — Travis S Chambers
(74) *Attorney, Agent, or Firm* — Wolf, Greenfield & Sacks, P.C.

(57) ABSTRACT

An electronic assembly with a sliding power connector mounted on a first substrate. The connector has tracks and terminals with contact fingers. A bus bar may be aligned by the tracks such that contact surfaces on the contact fingers press against contact surfaces on the bus bar. The electronic system may be implemented as a rack, and the electronic assembly may be or include a printed circuit board on which the power connector terminals are mounted. The printed circuit board may slide in and out of the rack while power is supplied from the bus bar to components on the printed circuit board. High reliability may be provided by one or more tabs on the housing that increase mating force of the contact fingers and/or prevent damage to the contact fingers from overstress. The contact fingers may be positioned to increase the lifetime of the system.

27 Claims, 6 Drawing Sheets

(51) Int. Cl.

| | |
|---|---|
| ***H01R 43/20*** | (2006.01) |
| ***H01R 13/24*** | (2006.01) |
| ***H01R 43/26*** | (2006.01) |
| ***H01R 13/405*** | (2006.01) |
| ***H01R 12/71*** | (2011.01) |

(52) U.S. Cl.
CPC ..... *H01R 13/2442* (2013.01); *H01R 13/405* (2013.01); *H01R 43/20* (2013.01); *H01R 43/26* (2013.01)

(58) Field of Classification Search
CPC ..... H01R 13/405; H01R 2103/00; H01R 12/714; H01R 12/7088; H01R 13/02; H01R 13/502; H01R 12/716; H01R 43/00; H01R 43/205; H01R 41/00; H01R 41/02; A47B 88/457; H01L 2224/75754; H01L 2224/80136; H01L 2224/80139; H01L 2224/81136; H01L 2224/81141; H01L 2224/83136; H01L 2224/84136
USPC ..... 439/64, 32, 110, 121, 122; 361/727
See application file for complete search history.

(56) References Cited

U.S. PATENT DOCUMENTS

| | | | | |
|---|---|---|---|---|
| 6,071,152 | A * | 6/2000 | Achammer | H01R 13/41 439/733.1 |
| 6,186,834 | B1 * | 2/2001 | Arnett | H01R 13/6464 439/676 |
| 6,210,177 | B1 * | 4/2001 | Huang | H01R 12/716 439/637 |
| 6,280,245 | B1 | 8/2001 | Han | |
| 6,299,492 | B1 | 10/2001 | Pierini et al. | |
| 6,979,228 | B2 * | 12/2005 | Zhang | H01R 12/721 439/660 |
| 7,976,321 | B2 * | 7/2011 | Schempp | H01R 43/20 439/108 |
| 8,021,200 | B2 * | 9/2011 | Myer | H01R 13/113 439/857 |
| 8,911,251 | B2 | 12/2014 | Ehlen | |
| 9,450,358 | B2 | 9/2016 | Ehlen | |
| 9,693,477 | B1 | 6/2017 | Ehlen | |
| 9,985,403 | B1 * | 5/2018 | Herring | H01R 12/7088 |
| 10,756,500 | B2 | 8/2020 | Herring et al. | |
| 11,183,786 | B2 | 11/2021 | Sabo et al. | |
| 2013/0335913 | A1 | 12/2013 | Brashers et al. | |
| 2020/0127402 | A1 | 4/2020 | Sabo et al. | |

* cited by examiner

HIGH RELIABILITY SLIDING POWER CONNECTOR

RELATED APPLICATIONS

This application claims priority and the benefit under 35 U.S.C. 119(e) of U.S. Provisional Patent Application Ser. No. 62/747,546, filed Oct. 18, 2018, entitled "HIGH RELIABILITY SLIDING POWER CONNECTOR".

BACKGROUND

This patent application relates generally to improvements in electrical connectors, such as a power connector that may be used in equipment racks.

Electronic systems are often assembled from multiple subassemblies installed in an equipment rack. The rack may contain interconnections that carry signals between the subassemblies so that the subassemblies may operate together as a system. The rack may also contain power supplies or other power distribution components that supply power to the subassemblies. For example, an electronic system may be assembled by installing into a rack subassemblies that contain processors, memory, and communications interfaces. These components may be mounted on one or more printed circuit boards ("PCBs") that provide a substrate on which to mount the components. The PCB also has conductive layers and traces that distribute power and signals to or among the components mounted to the PCB.

It is sometimes desirable for the subassemblies to be accessible by an installer, operator or repair technician working with the electronic system. To facilitate access, racks may have drawers in which the subassemblies are placed. When the drawers are pulled out, subassemblies inside can be easily accessed. Though the drawers, with subassemblies inside, might be closed for normal operation of the electronic system, it is sometimes desirable for the system to operate even when a drawer is pulled out.

In some systems, power may be supplied to the electronic components in the drawers through sliding power connectors. A power connector may be attached to a printed circuit board that is at a side or bottom of the drawer. The sliding power connectors may have spring fingers that mate with bus bars carrying power such that power is supplied from the bus bar, through the power connector to the PCB in the subassembly, and then to the electronic components of the subassembly. Such power connectors may supply power to the subassembly when the drawer is opened, when it is closed and when it is being slid between an opened and closed position.

BRIEF SUMMARY

According to one aspect of the present application, an electrical connector, which may be a power connector, is provided. The connector may comprise an insulative housing and a plurality of connector terminals held within the housing. Each of the plurality of connector terminals may comprise a plurality of contact fingers. Each of the plurality of contact fingers may comprise a contact surface at a distal end. The contact surfaces of the plurality of contact fingers of the plurality of connector terminals may face in a first direction. The housing may comprise a tab adjacent to and offset in the first direction from the distal ends of at least a portion of the plurality of contact fingers.

In some embodiments, the tab may be positioned to block bending in the first direction of contact fingers of the at least the portion of the plurality of contact fingers. In some embodiments, the at least the portion of the plurality of contact fingers may have a rest state. The tab may press against the distal ends of the at least the portion of the plurality of contact fingers such that the distal ends of the contact fingers are offset in a direction opposite the first direction from their rest states, whereby the tabs pre-load the contact fingers.

In some embodiments, the housing may comprise a plurality of tabs. The plurality of tabs may comprise the tab. Each tab of the plurality of tabs may be adjacent to and offset in the first direction from the distal ends of the plurality of contact fingers of a connector terminal of the plurality of connector terminals.

In some embodiments, the housing may comprise a plurality of tracks configured to guide a bus bar to slide relative to the plurality of connector terminals.

In some embodiments, the plurality of tabs may have distal ends contacting the distal ends of the plurality of contact fingers of the plurality of connector terminals. The contact surfaces of the plurality of contact fingers of the plurality of connector terminals may be offset in the first direction from the plurality of tracks. The distal ends of the plurality of tabs may be offset in a direction opposite the first direction from the plurality of tracks.

In some embodiments, an electronic assembly comprising the power connector in combination with a substrate is provided. The power connector may further comprise a plurality of tails integral with the connector terminals. The plurality of tails may be electrically and mechanically attached to the substrate.

In some embodiments, each of the plurality of connector terminals may further comprise a first side facing the first direction and a second side facing a second direction opposite the first direction. The plurality of contact fingers may extend on the first side in the first direction. The plurality of tails may extend on the second side in the second direction.

In some embodiments, each of the plurality of tracks may comprise an opening. The opening may face the plurality of contact fingers.

In some embodiments, each of the plurality of tracks may comprise a first surface parallel to the connector terminals and a second surface parallel to the first surface and offset from the first surface in the first direction. The opening of each of the plurality of tracks may be between the first surface and the second surface. The contact surfaces of the plurality of contact fingers may be spaced from the first surfaces of each of the plurality of tracks in a direction opposite the first direction.

In some embodiments, the plurality of tracks may be elongated in a sliding direction. The plurality of connector terminals may be disposed in a first and a second row. The first row may be spaced from the second row in the sliding direction.

In some embodiments, the plurality of contact fingers of the connector terminals in the first row may be offset from the plurality of contact fingers of the second row in a direction perpendicular to the sliding direction.

In some embodiments, the distal ends of the plurality of contact fingers of the connector terminals in the first row may extend towards the second row. The distal ends of the plurality of contact fingers of the connector terminals in the second row may extend towards the first row.

In some embodiments, the electronic assembly further comprises a second substrate. The second substrate may comprise a first edge slidably mounted within a first of the plurality of tracks, a second edge slidably mounted within a second of the plurality of tracks, and a plurality of elongated conductive surfaces between the first edge and the second edge. The contact surfaces of the plurality of contact fingers may contact the plurality of conductive surfaces.

In some embodiments, a method of operating the electronic assembly is provided. The method may comprise sliding the second substrate relative to the first substrate in the sliding direction.

According to another aspect of the present application, a method for pre-loading contact fingers in a connector comprising a plurality of connector terminals and an insulative housing, wherein each of the plurality of connector terminals comprises a conductive base and at least one contact finger integral with the base, the at least one contact finger each has a contact surface and a rest state with respect to the base, and the housing comprises at least one tab, is provided. The method may comprise inserting the plurality of connector terminals into the housing such that distal ends of the at least one contact finger of each of the plurality of connector terminals contacts a tab of the at least one tab, further inserting the plurality of connector terminals into the insulative housing such that, for each of the plurality of terminals, the at least one contact finger is deflected in a direction from its rest state towards the base as a result of contact with the tab, and securing the plurality of connector terminals to the housing with contact surfaces of the at least one contact fingers of the plurality of connector terminals exposed through at least one opening in the housing and facing in a first direction such that the at least one contact fingers of the plurality of connector terminals are retained in a state deflected from their respective rest states.

In some embodiments, the at least one contact finger may comprise a plurality of contact fingers.

In some embodiments, the housing may further comprise a plurality of tracks. Each of the plurality of tracks may comprise an opening. The openings may face the plurality of contact fingers.

In some embodiments, a first of the plurality of tracks may be configured to receive a first edge of a bus bar. A second of the plurality of tracks may be configured to receive a second edge of the bus bar. Contact surfaces at the distal ends of the plurality of contact fingers may be configured to contact a plurality of elongated conductive surfaces between the first edge and the second edge of the bus bar.

According to another aspect of the present application, a sliding power connector is provided. The connector may comprise a housing and a plurality of power connector terminals mounted in the housing. The housing may comprise a track elongated in a sliding direction and configured to guide an edge of a bus bar. Each of the plurality of power connector terminals may comprise a plurality of contact fingers. Each of the plurality of contact fingers may comprise a contact surface thereon. At least a first of the plurality of power connector terminals may be offset from a second of the plurality of power connector terminals in the sliding direction. The contact surfaces of the plurality of contact fingers of the first power connector terminal may be positioned to make wear tracks on a bus bar sliding in the track that are interspersed with and offset, in a direction perpendicular to the sliding direction, from wear tracks on the bus bar made by the contact surfaces of the plurality of contact fingers of the second power connector terminal.

In some embodiments, the housing may further comprise a plurality of windows exposing the plurality of connector terminals.

In some embodiments, each of the plurality of power connector terminals may further comprise a conductive base and a plurality of tails extending from the base in a second direction opposite the first direction. The plurality of contact fingers may extend from the base in a first direction. The plurality of tails may be configured for electrically and mechanically connecting to a first substrate.

In some embodiments, a first group of the plurality of windows may expose the plurality of contact fingers of the plurality of connector terminals. A second group of the plurality of windows may expose the plurality of tails of the plurality of connector terminals.

In some embodiments, the first connector terminal may be offset from the second connector terminal in the direction perpendicular to the sliding direction.

In some embodiments, the first connector terminal may be aligned with the second connector terminal in the sliding direction.

In some embodiments, the housing may further comprise a tab adjacent to and offset in the first direction from the distal ends of at least a portion of the plurality of contact fingers. The tab may be positioned to block bending in the first direction of contact fingers of the at least the portion of the plurality of contact fingers.

In some embodiments, the track may be a first track. The housing may further comprise a second track. The first track may be configured to guide a first edge of the bus bar. The second track may be configured to guide a second edge of the bus bar.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1A:
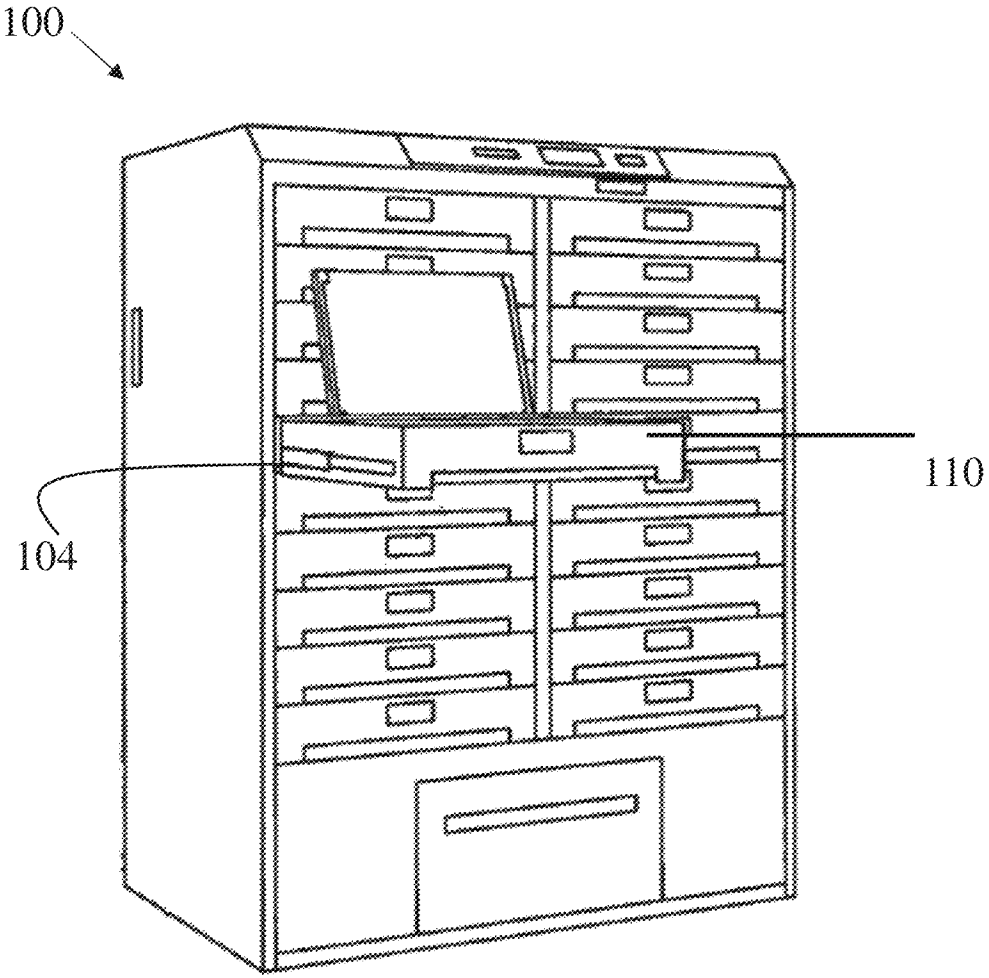
FIG. 1A is a perspective view of an exemplary equipment rack in accordance with some embodiments.

The inventors have recognized design techniques for sliding connectors that can improve their reliability and/or provide additional flexibility in use. These techniques may be used separately or in any suitable combination.

In some aspects, a sliding power connector having an insulative housing and one or more sliding power connector terminals may be mounted to a printed circuit board or other substrate as part of an electronic assembly. The terminals of the connector may have sliding contacts that mate to a second substrate with elongated surfaces through which power may be supplied. The second substrate, for example, may be a bus bar in an equipment rack or other electronic system. With this configuration, the electronic assembly may receive power in any of multiple positions relative to the electronic system and may even receive power as it slides in and out of the electronic system, such as occurs when the electronic assembly is in a drawer of the electronic system that may be opened and closed.

A track may be formed in or attached to the connector housing, on which the second substrate may be positioned relative to the sliding contacts. Other features of a power connector optionally may be integrally formed with the housing or the sliding contacts. For example tails for attaching the power terminals to the printed circuit board may be integrally formed with the sliding power contacts. A tab, to preload and/or avoid overstressing the sliding contacts may be integrally formed with the housing. Alternatively, the tab could be a separate part coupled to the housing.

In some embodiments, multiple terminals may be used together with a housing to form a sliding power connector, which may be mounted on a printed circuit board or other substrate. The terminals may be exposed through windows in the housing. Tracks formed in the housing may face each other, spaced to receive the second substrate between them. The terminals may thus be exposed to the second substrate through the windows in the housing.

In another aspect, the sliding contacts of the terminals may be positioned within the connector to reduce wear on elongated surfaces of the second substrate through which power may be supplied. In some embodiments, contact surfaces may be positioned at distal ends of the contact fingers of one or more terminals of the connector. Multiple terminals mounted to the first substrate may be configured relative to the housing such that groups of contact fingers of the terminals are offset from each other in a sliding direction of the second substrate relative to the first substrate. The groups of contact fingers also may be offset from each other in a direction perpendicular to the sliding direction. The contact surface groups that are offset in the sliding direction and in a perpendicular direction may contact the same surface of the second substrate, but each contact surface may contact the surface along different wear paths as the second substrate slides relative to the first substrate. Such a configuration may create more wear tracks parallel to the sliding direction than would be created with groups of contact surfaces aligned in the sliding direction, but each wear track will be shallower because it is formed by fewer contact surfaces sliding along that wear track.

In some embodiments, a sliding power connector having a housing and four or more terminals exposed through windows in the housing may be mounted to a substrate such that the contact surfaces of the terminals are positioned in rows, which extend perpendicular to a sliding direction. The rows may be parallel to each other. One or more of the contact surfaces within each of two such rows, offset from each other in the sliding direction, may contact the same elongated surfaces on the second substrate. Those two rows may have patterns of contact surfaces offset from each other in the direction perpendicular to the sliding direction such that the contact surfaces within those two rows contact different locations on the elongated surfaces. Such a configuration may create more wear tracks parallel to the sliding direction than would be created with patterns of contact surfaces aligned in the sliding direction, but each wear track will be shallower because it is formed by fewer contact surfaces sliding along that wear track. If there are three or more rows, the contact surfaces in the third, or additional rows, may be offset from the contact surfaces in some or all of the other rows. As a result, contact surfaces on the contact fingers and/or elongated surfaces on the second substrate may last longer, allowing more operational cycles of the drawer of the rack.

In yet another aspect, the contact fingers may extend along the sliding direction, with the distal ends of the contact fingers of at least the outer rows extending towards the distal ends of the contact fingers of a neighboring row. The contact surfaces would thereby be closer to the middle of the connector, thus extending the effective sliding range of the drawer along its track while maintaining a power connection.

Exemplary embodiments of sliding electrical power connector assemblies, and electronic assemblies using those connector assemblies, are illustrated in the figures.

Referring to FIG. 1A, an equipment rack 100 may contain drawers 110 which may slide in and out of the equipment rack 100 on drawer tracks 104. Tracks 104 are elongated, defining a sliding direction for the subassembly, corresponding to the direction in which the drawer slides along the tracks. Each of the drawers may hold an electronic assembly, such as a PCB on which a processor, memory or other components are mounted. The drawers may slide out to provide access to the assembly. The drawers may serve other functions, such as to organize cables carrying signals to and from the components of the assembly.

Figure 1B:
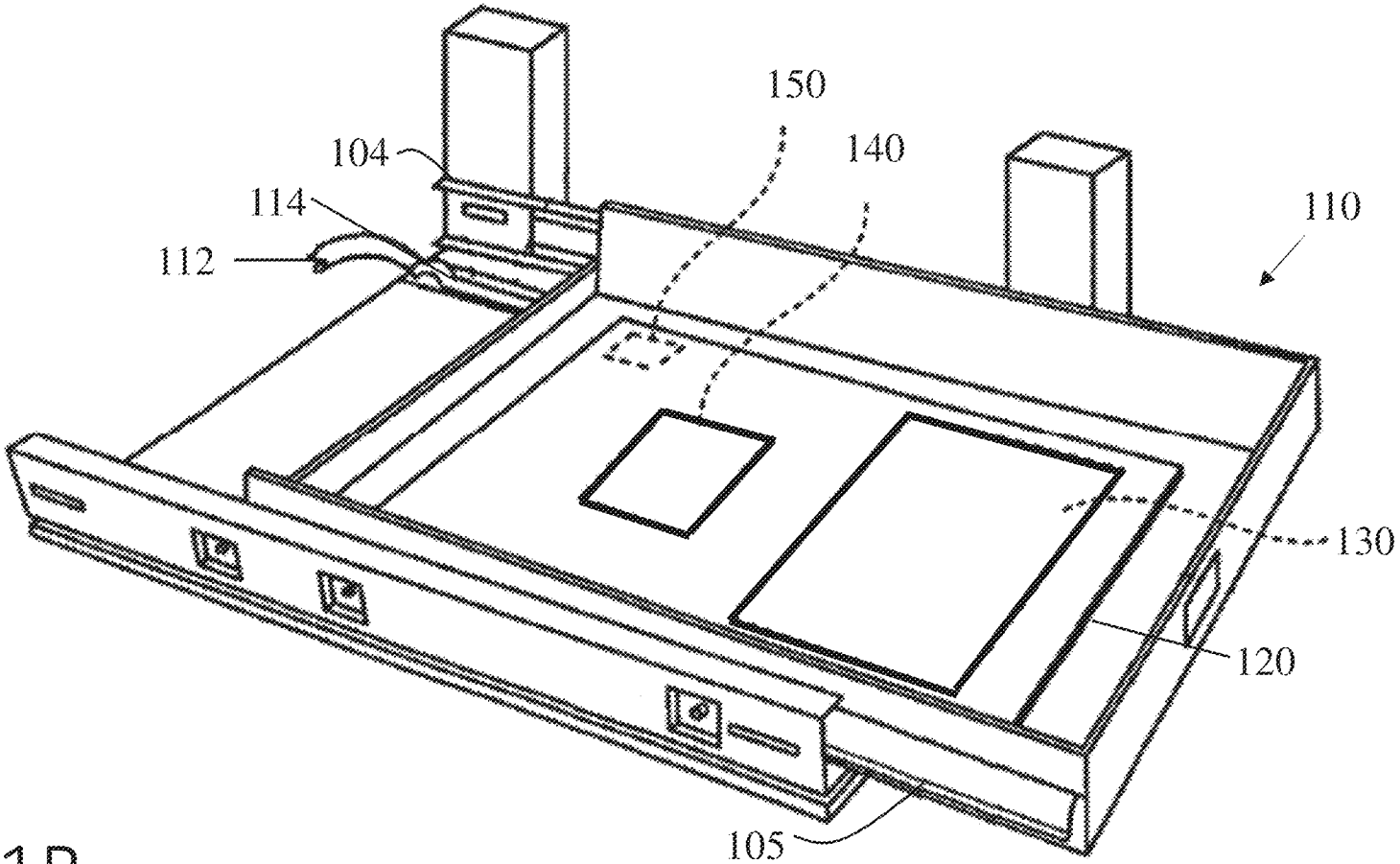
FIG. 1B is a perspective view of an exemplary drawer cut away from the equipment rack of FIG. 1A and which contains electronic equipment in accordance with some embodiments.

FIG. 1B illustrates a drawer 110, cut away from equipment rack 100. Drawer 110 may contain electronic components such as a PCB 120. PCB 120 may comprise a functional circuit 130 and a communication circuit 140. Such circuits may be implemented by attaching integrated circuit devices, such as processors, memory and/or transceivers to PCB 120.

Power may be supplied to the components mounted to PCB 120 through power planes within PCB 120. That power may be supplied to PCB 120 from one or more bus bars 114 within equipment rack 100, which in turn may be connected to a power supply (not shown) either internal or external to equipment rack 100, such as via a cable 112. In the embodiment illustrated, one or more sliding power connectors are mounted to host PCB 120 in region 150. The connectors couple power from bus bar 114 to the PCB 120. Terminals of such a connector may have mounting tails that engage power planes within PCB 120.

The one or more of the power connectors mounted to region 150 may be configured to make electrical contact with bus bar 114. In the embodiment illustrated, contact fingers of the connector have contact surfaces at distal ends. The contact fingers provide a spring force, pressing the contact surfaces against surfaces on the bus bar 114. Those surfaces on bus bar 114 may be elongated in the sliding direction. As a result, the contact fingers may slide along surfaces on bus bar 114 as drawer 110 is opened or closed. Such a configuration enables power to be supplied from bus bar 114 to PCB 120 while drawer 110 is opened, closed or at any intermediate location.

Bus bar 114 may have any desired configuration. In some embodiments, bus bar 114 may have two elongated surfaces configured to mate with terminals of the connector. Such a configuration, with two electrically separate elongated surfaces, may be used to provide a supply and return path at a single voltage level, such as 12 Volts. Alternatively, two elongated surfaces may provide two supply paths at two different voltages, such as +12V and −12V. However, any suitable voltage level may be supplied on each of the elongated surfaces. Moreover, any suitable number of elongated surfaces may be present. Embodiments are illustrated in which there are two elongated surfaces, each of which aligns with one or more sets of contact fingers of the connector within region 150. In other embodiments, three or more elongated surfaces may be provided on bus bar 114, with groups of contact fingers of the connector aligned with each elongated surface.

Bus bar 114 may be implemented in any suitable way. In some embodiments, bus bar 114 may be implemented as a power supply printed circuit board ("PCB"). In the embodiment of FIG. 1B, bus bar 114 is elongated in a direction parallel to and runs alongside the drawer tracks 104. Elongated surfaces on bus bar 114 may be formed as conductive pads 116 and 118. The elongated surfaces 116 and 118 may be conductive and may serve as contact regions of the bus bar 114. Contact fingers of the power connector may make mechanical and electrical contact to these contact regions. In the orientation shown in FIG. 1B, region 150 is located on a lower surface of PCB 120. Bus bar 114 is mounted below PCB 120, with the contact regions facing PCB 120.

Figure 2:
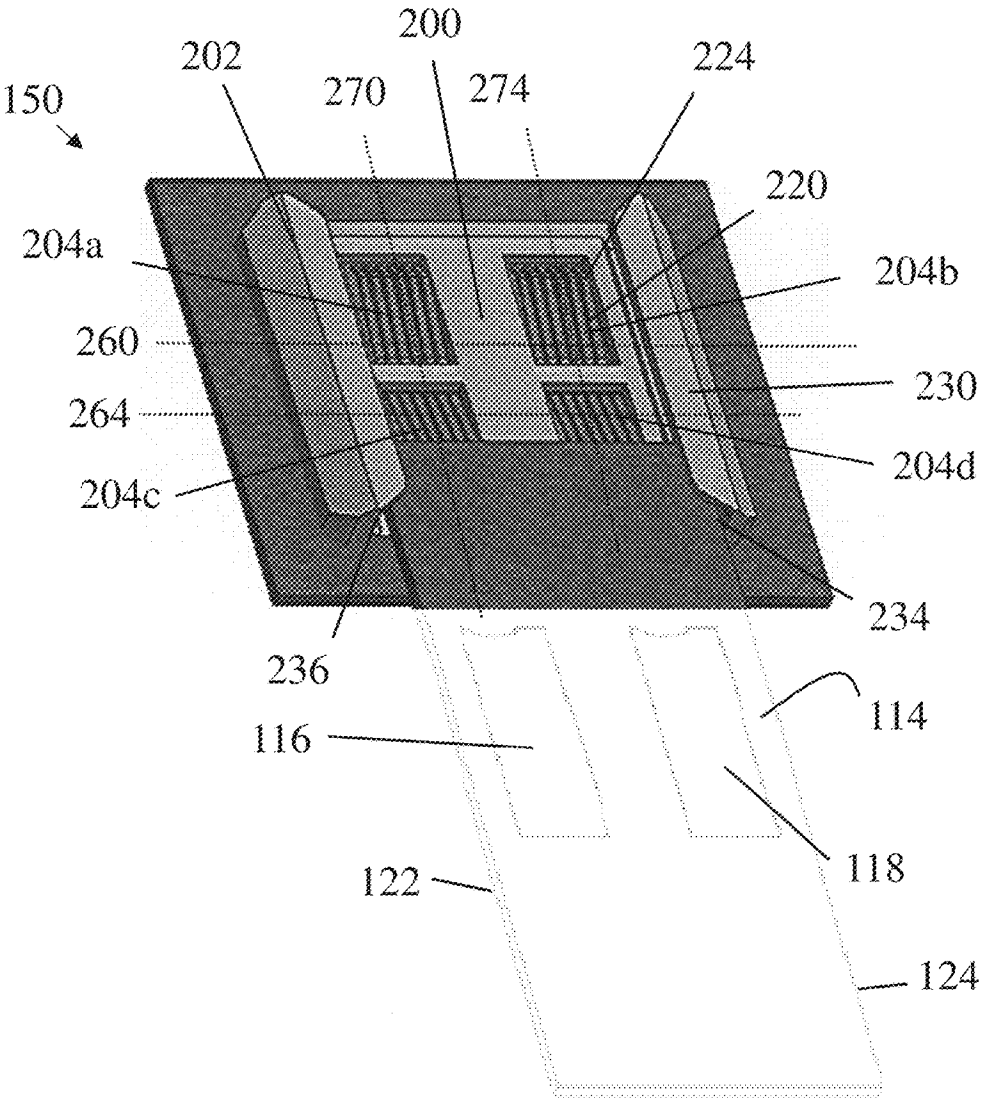
FIG. 2 is a perspective view of an exemplary embodiment of a portion of a sliding electronic assembly with a power connector.

FIG. 2 shows the bottom view of a portion of the lower surface of PCB 120 including region 150 where a connector 200 is mounted. Bus bar 114 has a first edge 122 and a second edge 124, with contact regions between these edges. In the embodiment illustrated, two contact regions 116 and 118 are illustrated. The contact regions are on the surface of bus bar 114 facing region 150. In the view of FIG. 2, the contact regions are on the surface of bus bar 114 that is not visible such that the contact regions are shown in phantom. Contact regions 116 and 118 are shown extending along only a portion of the length of bus bar 114. That depiction is for simplicity of illustration as, in some embodiments, contact regions will extend over the entire length of bus bar 114 that will be adjacent to region 150 when PCB 120 slides relative to bus bar 114. However, it is not a requirement and contact regions 116 and 118, which are connected to voltage supplies delivering power through bus bar 114, may be present on bus bar 114 in a discrete location or locations in which terminals will engage the contact regions 116 and 118.

In the embodiment illustrated in FIG. 2, connector 200 has an insulative housing 202 and multiple terminals 204*a-d* exposed through the housing 202. In the embodiment illustrated in FIG. 2, the terminals 204*a-d* are exposed through windows in the housing 202, and each of the terminals 204*a-d* has the same configuration, with terminals 204*a-b* being oriented 180 degrees relative to terminals 204*c-d*. Accordingly, any of terminals 204*a-d* may be represented by terminal 204 in FIG. 3.

Figure 3:
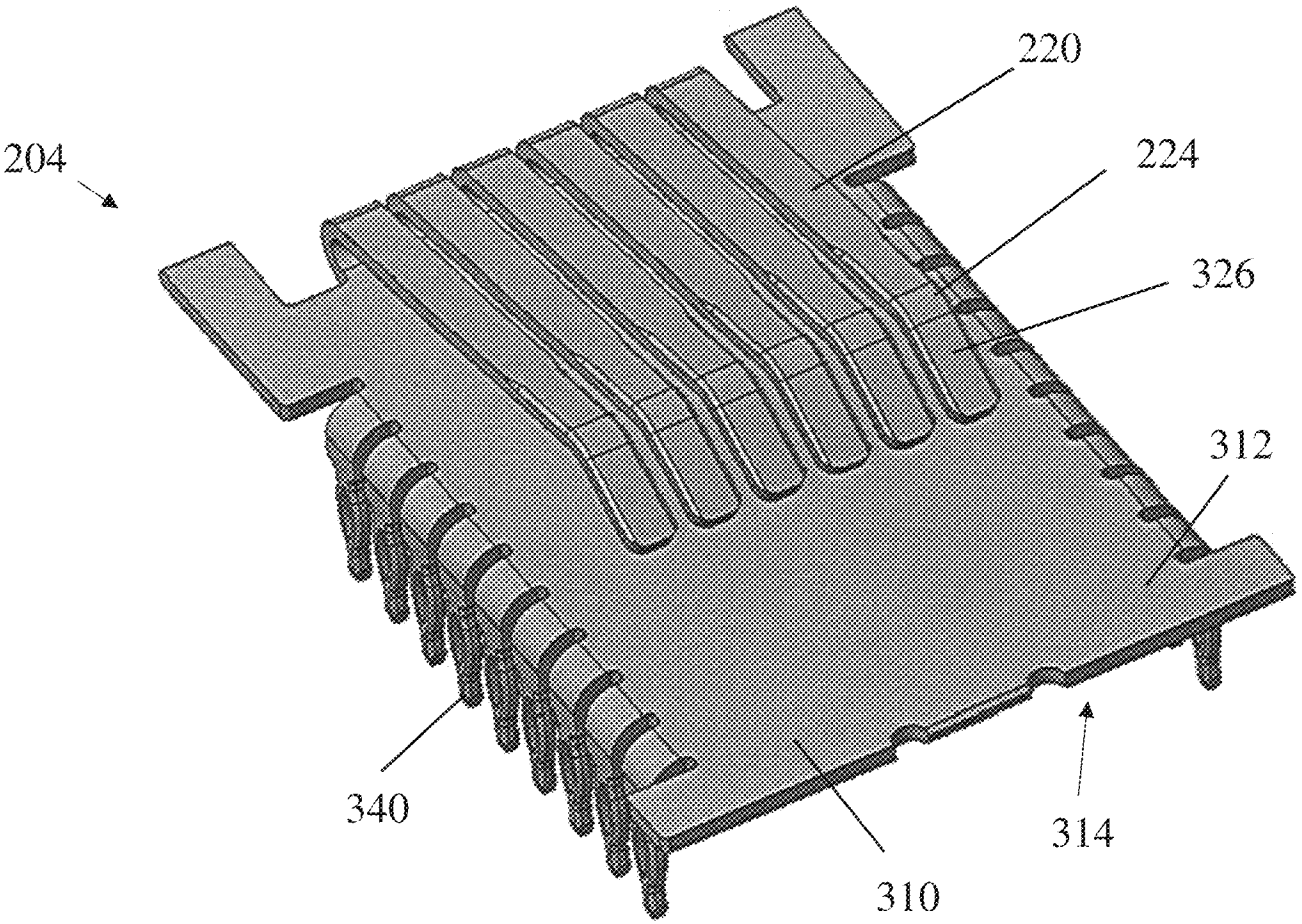
FIG. 3 is a perspective view of an exemplary embodiment of a power connector terminal as illustrated within the power connector of FIG. 2.

Each terminal 204 may comprise contact fingers 220 and tails (illustrated in FIG. 3). The contact fingers 220 and tails may be exposed through the housing 202. For example, the contact fingers and the tails may each be exposed through windows in the housing 202. The contact fingers 220 may further comprise contact surfaces 224 facing in a first direction. The terminals 204*a-d* may be held within the housing 202. For example, the housing may hold the terminals 204*a-d* in place while being mounted to the PCB 120.

The housing 202 may be formed of any suitable electrically insulative material, such as plastic, and may comprise one or more integrated tracks 230. For example, the housing 202 may be formed in a molding process. The tracks 230 may be formed in the same molding process as the rest of the housing 202 or each may be formed separately and attached together. Each of the tracks 230 may comprise a first surface parallel to the terminals 204*a-d* and a second surface parallel to the first surface and offset from the first surface in the first direction.

The tails may be configured for mounting to the host PCB 120. For example, the tails may be configured to be press fit into holes in the host PCB 120. Alternatively, the tails may be electrically and mechanically coupled to the host PCB 120 in any other way. The host PCB 120 may contain conductive traces connecting the tails to a portion of the communication circuit 140 and/or the functional circuit 130.

The tracks 230 in the housing 202 may be configured to receive the bus bar 114 in a sliding direction. Each track 230 may comprise an opening 234 disposed between the first and second surfaces. The opening 234 may face the contact fingers 220, and one or more of the contact surfaces 226 may be spaced from the opening 234 in a second direction opposite the first direction. The openings 234 may comprise a lead-in portion 236 at one or multiple ends of the track 230. The lead-in portion 236 may flare out away from where the bus bar 114 is received, or may otherwise widen the opening 234 to facilitate insertion of the bus bar 114 into the opening 234 of the track 230. In the illustrated example, the opening 234 continuously flares outwardly away from the bus bar 114 at the lead-in portion 236 as the track 230 reaches an end.

As shown in FIG. 2, the connector 200 may be mounted such that the tracks 230 in the housing 202 are positioned to capture bus bar 114. As illustrated, two tracks 230 in the housing 202 face one another. Further, each of the tracks 230 extend in the sliding direction. In this way, edge 122 of bus bar 114 may be retained in one of the tracks 230. Likewise, another of the tracks 230 may retain edge 124 of the bus bar 114. The openings 234 in the tracks 230 in the housing 202 may be wider than the thickness of bus bar 114 such that bus bar 114 may slide within those tracks 230.

FIG. 2 shows that, within region 150, the terminals 204*a-d* of the connector 200 are disposed in an array, enabling multiple points of contact to the same conductive surface on bus bar 114 and/or to multiple conductive surfaces that are electrically separated. The terminals 204*a-d*, for example, may be positioned in first column 270 and second column 274 extending along the sliding direction. The opening 234 of the track 230 adjacent the first column 270 may be configured to receive the first edge 122 of the bus bar 114, and the track 230 adjacent the second column 274 may be configured to receive the second edge 124 of the bus bar 114. The contact surfaces 224 of the contact fingers 220 may be configured to contact the conductive surfaces of the bus bar 114. As the drawer 110 slides along the drawer tracks 104, the contact surfaces 224 of the contact fingers 220 may thereby slide along the conductive surfaces of the bus bar 114. Sliding of the contact fingers 220 along the conductive surfaces of the bus bar 114, concurrent with the tails being mounted to the host PCB 120, may establish an electrical connection between components of the host PCB 120 and the bus bar 114.

The connector 200 may further comprise a first row 260 and a second row 264 of terminals 204*a-d* which may extend along a direction perpendicular to the sliding direction. In the illustrated embodiment, in which the terminals 204*a-d* are used, there may be two terminals in each row, each disposed adjacent a track 230 at each end of the row. In other embodiments, each row may have more or fewer than two connector terminals. The contact fingers 220 of the terminals 204*a-d* within each row may extend in the same direction along the sliding direction as illustrated in FIG. 2, or they may extend in opposite directions along the sliding direction. The contact surfaces 224 of the contact fingers 220 may be aligned along a row, even if the contact fingers 220 of adjacent terminals within the row extend in opposite directions. Similarly, the terminals 204*a-d* within each column may extend in opposite directions along the sliding direction, as is illustrated in the configuration of FIG. 2, or they may extend in the same direction along the sliding direction.

The inventors have recognized and appreciated that position and orientation of the contact fingers may impact functionality of a system using a connector 200. The travel distance of the region 150 along the bus bar 114 during which the power connection is established, for example, may be increased if the contact fingers 220 of the first row 260 extend towards the second row 264, and the contact fingers 220 of the second row 264 extend towards the first row 260. Additionally, wear on the contact surfaces 116 and 118 may be reduced for a longer lifetime if the contact fingers 220 of the first row 260 are offset from the contact fingers of the second row 264 in the direction perpendicular to the sliding direction.

Turning to FIG. 3, a power connector terminal 204 (one of the terminals 204*a-d* as illustrated in FIG. 2) is illustrated. Terminal 204 may be formed from an electrically conductive material that is suitably springy to form electrical contacts. Suitable materials include copper alloys or other metal alloys known in the art of power connector manufacture. In accordance with some embodiments, terminal 204 may be manufactured from a sheet of metal that is blanked and formed into the desired configuration. Terminal 204 may comprise a base 310, with contact fingers 220 and tails 340 extending from base 310. Contact fingers 220 may further comprise contact surfaces 224 at distal ends 326. The power connector terminal 204 may be manufactured from a single sheet of metal. For example, portions of the base 310 may be stamped or bent or otherwise manipulated into contact fingers 220, tails 340 or other features.

The base 310 may comprise a first side 312 which may face a first direction and a second side 314 which may face a second direction opposite the first direction. Contact fingers 220 may extend in the first direction, and tails 340 may extend in the second direction. In this way, connector terminal 204 and the housing 202 may be mounted together to a PCB with the second side 314 exposed through the housing 202 adjacent the PCB and the first side 312 exposed through the housing 202 facing a bus bar that can be adjacent the surface of the printed circuit board. For example, the housing 202 may comprise one or more windows on one or both of the first side 312 and second side 314 through which the contact fingers 220 and/or tails 340 may be exposed to the PCB and/or the bus bar.

Other features alternatively or additionally may be incorporated in some or all of the terminals in a power connector. Those features may also be integrally formed with the base or may, in some embodiments, be incorporated in other ways.

Figure 4:
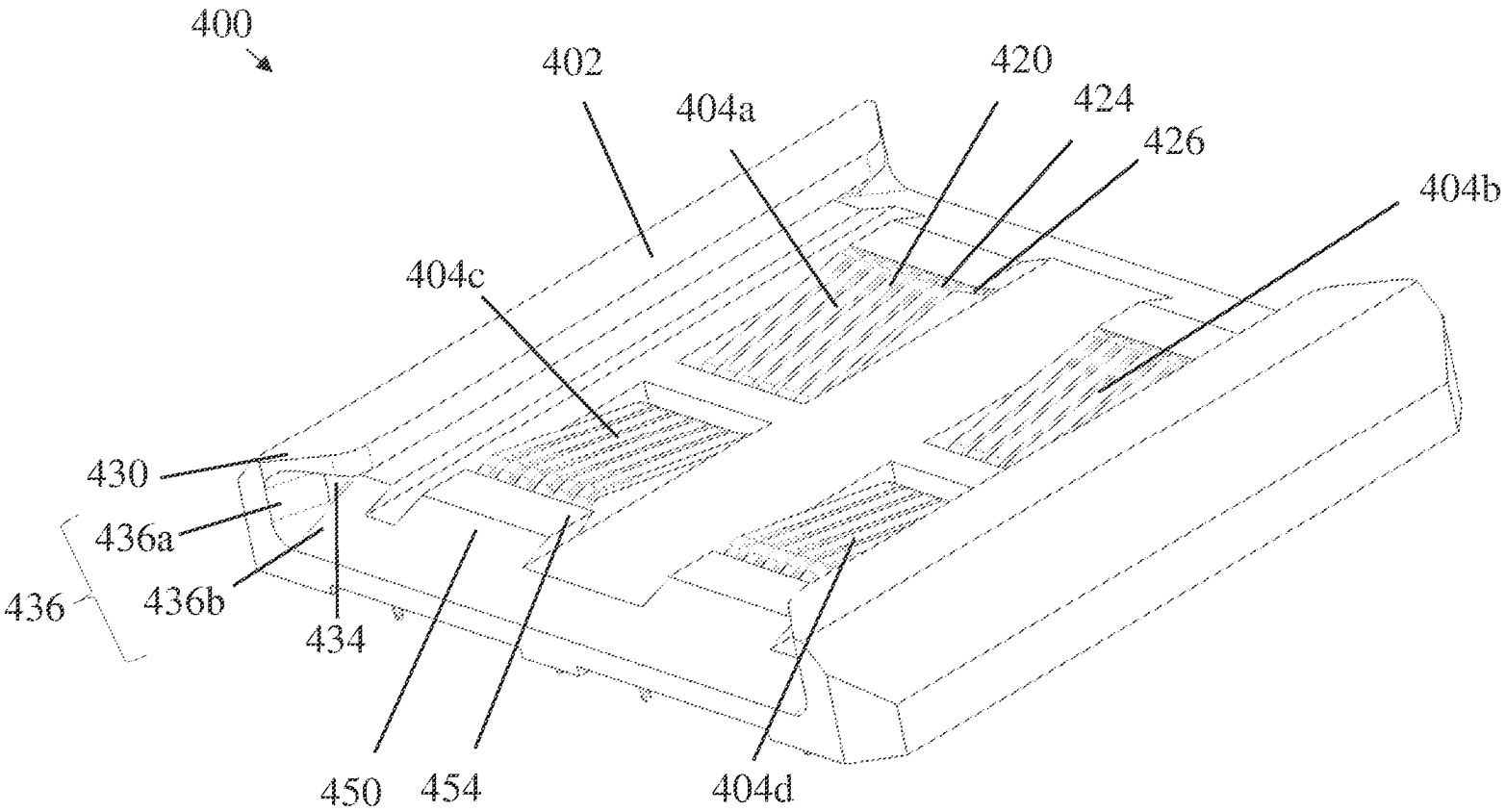
FIG. 4 is a perspective view of an exemplary embodiment of a sliding power connector in which spring fingers are preloaded and/or protected from overstress by tabs of the housing.

FIG. 4 shows a sliding power connector 400 with a housing 402 having integrated or attached tabs which may pre-load or prevent over-stressing of contact fingers 420. Like connector 200, connector 400 has connector terminals 404*a-d* with contact fingers 420 having contact surfaces 424 at distal ends 426. The housing 402 comprises one or more tracks 430, and may further comprise one or more tabs 450. As can be clearly seen in FIG. 4, tracks 430 are shown including an opening 434 and a lead-in portion 436 including surfaces 436*a* and 436*b*. The contact surfaces 424 may face a first direction, and one of the tabs 450 may be adjacent to and offset from the distal ends 426 of at least a portion of the contact fingers 420 in the first direction. In FIG. 4, tabs 450 are illustrated as integral with the housing 402. The tabs 450 may be formed as part of molding housing 402. Alternatively to being formed integral with the housing 402, the tabs 450 may be formed separately and then attached to the housing 402.

In either case, a portion 454 of one or more of the tabs 450 may be positioned adjacent distal ends 426 of contact fingers 420 of one or more of the terminals 404*a-d*. Portions 454 are shown offset from the contact fingers 420 of each of the terminals 404*a-d* in the first direction such that each portion 454 blocks bending of the contact fingers 420 of the one of the terminals 404*a-d* in the first direction. In such a configuration, tabs 450 may prevent damage to the contact fingers 420 of the terminals 404*a-d* as a result of overstressing the contact fingers by bending them in the first direction.

Alternatively or additionally, tabs 450 may preload the contact fingers 420 of one or more of the terminals 404*a-d*. Contact fingers 420 are spring contacts. They may extend sufficiently above one or more of the terminals 404*a-d* that, when a bus bar (such as bus bar 114) is inserted into the tracks 430, the bus bar will press on the contact fingers 420. Contact fingers 420 of the one or more terminals 404*a-d* will be deflected opposite the first direction and towards a base of the one of the terminals 404*a-d*. This deflection of the contact fingers 420 will generate a spring force on the surface of the bus bar. This force should be sufficiently large to ensure a reliable electrical contact between the contact fingers 420 and the surface of the bus bar. One or more of the tabs 450 may increase this contact force by preloading the contact fingers 420 of one or more of the terminals 404*a-d*. Preloading may result because each of the contact fingers 420 has a rest state—a position that it will spring into when no force is acting on it. The force generated by each contact finger 420 may depend on the amount the contact finger 420 is deflected from its rest state.

Contact fingers 420 may be bent such that their rest states are beyond the track 430 in the first direction. One or more of the tabs 450 will hold the distal ends 426 sufficiently below track 430 that, when a bus bar (such as bus bar 114) is inserted into track 430, it does not strike the distal ends 426 of the contact fingers 420, which might damage the one of the terminals 404*a-d* or prevent contact between the one of the terminals 404*a-d* and the bus bar. When the contact fingers 420 are deflected to contact a surface of a bus bar in track 430, the amount the contact fingers 420 are deflected may equal the amount by which the rest state of the contact surfaces 424 extend above the tracks 430. When one or more tabs 450 are used, contact fingers 420 may be bent such that the amount of deflection from the rest state is much larger than would be possible if the distal ends 426 of the contact fingers 420 had to be below track 430. Accordingly, increased spring force may be generated with one or more tabs 450. The inventors have recognized and appreciated that the tabs 450 prevent overstressing of the contact fingers 420 and increase the spring force with which the contact fingers 420 can be applied to the bus bar 114.

Figure 5:
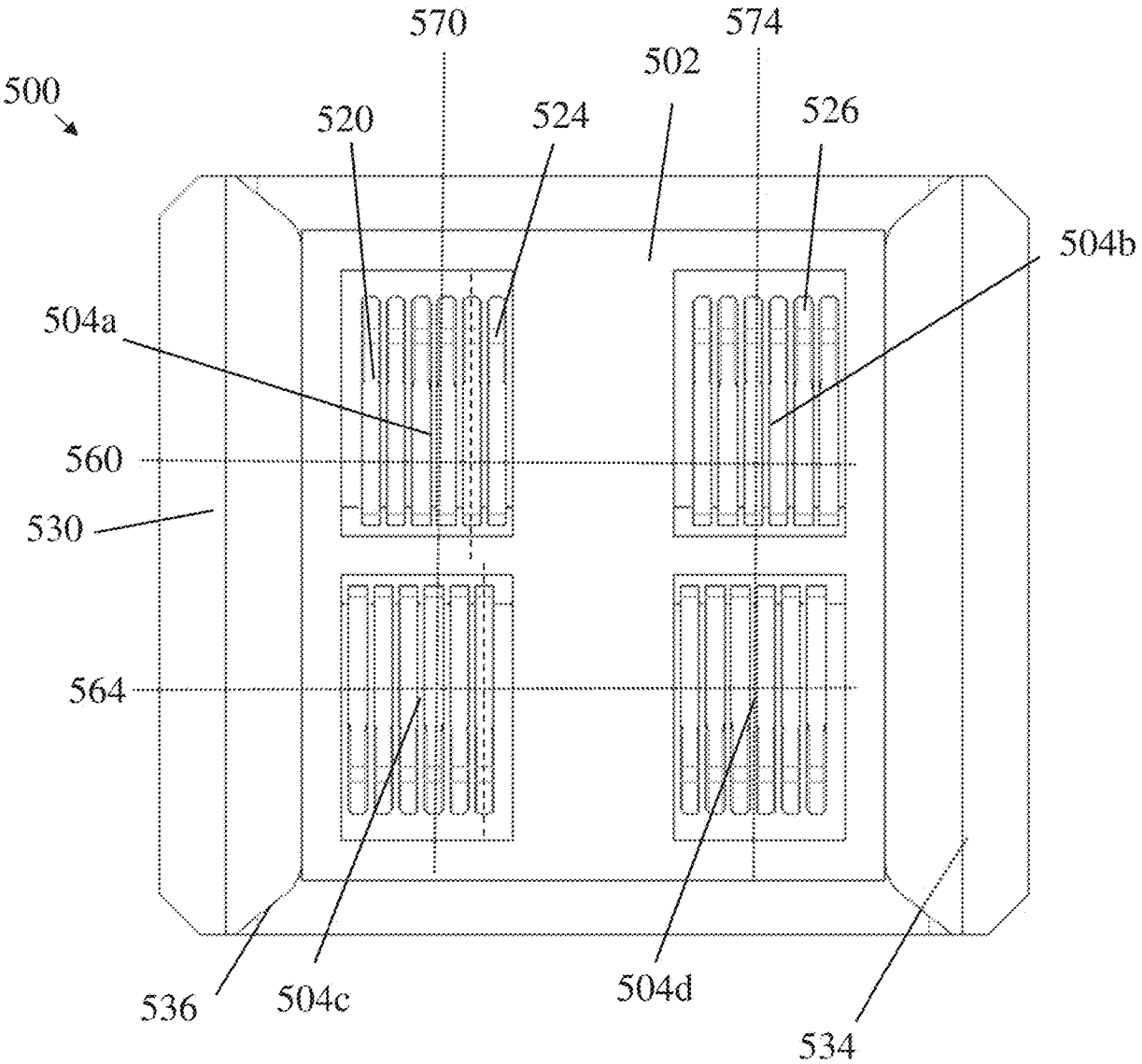
FIG. 5 is a top view of an exemplary embodiment of a sliding power connector in which the contact fingers are disposed in an offset configuration.

In FIG. 5, an embodiment of a sliding power connector 500 is illustrated having offset contact surfaces 524. Like connectors 200 and 400, connector 500 comprises a housing 502 with one or more tracks 530 and connector terminals 504*a-d*. Connector terminals 504*a-d* each comprise contact fingers 520 having contact surfaces 524 and/or other components described in connection with terminals 204*a-d* and 404*a-d* of connectors 200 and 400 of FIGS. 2 and 4 respectively. Housing 502 may or may not comprise one or more tabs as described in FIG. 4. In the illustrated embodiment, connector terminals 504*a* and 504*c* are offset in the sliding direction.

The contact surfaces 524 may be positioned to make wear tracks on a bus bar sliding relative to region 150. Contact surfaces 524 on contact fingers 520 of connector terminals 504*a* and 504*c* may be offset in a direction perpendicular to the sliding direction, such that wear tracks on the bus bar of those contact fingers are suitably offset in the direction perpendicular to the sliding direction. For example, the connector terminals 504*a* and 504*c* or contact fingers 520 on the terminals 504*a* and 504*c* may be offset in the direction perpendicular to the sliding direction. Windows in the housing 502 may be shifted to accommodate the offset contact surfaces 524, contact fingers 520 and/or terminals 504*a* and 504*c*.

In the illustrated embodiment, contact fingers 520 of connector terminals 504*a* and 504*c* are shifted by one-half a width of the contact fingers 520 in the direction perpendicular to the sliding direction. However, the contact surfaces 524 and/or contact fingers 520 of connector terminals 504*a* and 504*c* and/or the terminals 504*a* and 504*b* themselves may alternatively be shifted by an amount greater or less than that which is illustrated. It should also be appreciated that the connector terminals 504*a* and 504*c* and/or the contact fingers 520 may be aligned in the sliding direction, but may be configured such that the contact surfaces 524 of the connector terminals 504*a* and 504*c* are offset in the direction perpendicular to the sliding direction by any suitable amount. For example, the contact fingers 520 may be disposed in offset positions within the connector terminals 504*a* and 504*c*. Further, the contact fingers 520 may be aligned, but the contact surfaces 524 may still be offset in the direction perpendicular to the sliding direction. It should further be appreciated that more connector terminals may be adjacent connector terminals 504*a* and/or 504*c* in the sliding direction or the direction perpendicular to the sliding direction, and that within groups of two or more connector terminals, contact surfaces of one connector terminal may be offset with respect to some or all of the other connector terminals in the direction perpendicular to the sliding direction. The inventors have recognized and appreciated that a configuration having offset connector terminals, contact fingers and/or contact surfaces may create more wear tracks parallel to the sliding direction than would be created with groups of contact surfaces aligned in the sliding direction, but each wear track will be shallower because it is formed by fewer contact surfaces sliding along that wear track. Shallower wear tracks may result in a longer device lifetime and/or more reliable operation of the device.

Having thus described several embodiments, it is to be appreciated various alterations, modifications, and improvements may readily occur to those skilled in the art. Such alterations, modifications, and improvements are intended to be within the spirit and scope of the invention. Accordingly, the foregoing description and drawings are by way of example only.

Various changes may be made to the illustrative structures shown and described herein. For example, conductive surfaces on a bus bars may be continuous over the range of locations at which contact surfaces of the connector terminals contact the bus bar. However, it is not a requirement that the conductive surfaces be continuous over the range of relative motion of the bus bar and the connector terminals. Conductive surfaces may be provided at one or more discrete locations on the surface of the bus bar such that power is supplied to an electronic assembly when it is in one or more discrete positions relative to an electronic system containing the bus bar.

Further, bus bars are described as supplying power. It should be appreciated that providing a return path for current may be part of supplying power, such that a bus bar, as described herein, may be connected to a terminal of a power supply of positive or negative voltage that sources current or may be connected to a supply, ground or other suitable terminal that sinks current.

Moreover a bus bar is described as having conductive surface portions on a surface of a substrate. Such a bus bar may be constructed using known power PCB construction techniques in which the substrate is formed of alternating layers of conductive metal in insulator that are electrically connected with vias passing through the layers. In other embodiments, the conductive surfaces and the substrate may be integral. For example, the bus bar may be formed as a solid piece of metal, in which case the surface and the substrate would be portions of the same component. Other configurations are similarly possible, such as a bus bar formed by laminating multiple metal layers.

As an example of yet a further variation, it is described that each connector terminal has one or more contact fingers integrally formed with a base. Each base may have, for example, a single set of contact fingers with contact surfaces aligned in a row. Other construction techniques are possible. The contact fingers may be formed separately from the base and subsequently attached to it. The contact fingers may be attached by welding, brazing, soldering, crimping or in any other suitable way. Alternatively, multiple sets of contact fingers may be integrally formed with or attached to a single base. For example, the sets of contact fingers shown above as parts of separate connector terminals 204*a-d*, each having its own base, could be integrally formed with one longer base.

As yet another example, sliding of a bus bar relative to a connector is described. In a system as illustrated in FIG. 1, for example, relative sliding may be the result of opening or closing a drawer containing a PCB with a connector thereon. In that configuration, the bus bar may have a fixed position and the PCB may move. However, relative sliding may result if the bus bar is in the drawer that moves relative to the connector. Accordingly, it should be appreciated that sliding as used herein, unless otherwise qualified, refers to relative motion of components, without regard to which, if any, of the components is stationary.

Various aspects of the present invention may be used alone, in combination, or in a variety of arrangements not specifically discussed in the embodiments described in the foregoing and is therefore not limited in its application to the details and arrangement of components set forth in the foregoing description or illustrated in the drawings. For example, aspects described in one embodiment may be combined in any manner with aspects described in other embodiments.

Also, the invention may be embodied as a method, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

Use of ordinal terms such as "first," "second," "third," etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

What is claimed is:

1. A power connector, comprising:

an insulative housing;

at least one connector terminal held within the insulative housing, the at least one connector terminal comprising:

at least one conductive base;

a plurality of contact fingers arranged in a plurality of groups of parallel contact fingers integral with and extending from a conductive base of the at least one conductive base, wherein each of the plurality of contact fingers comprises a contact surface at a distal end; and wherein:

the contact surfaces of the plurality of contact fingers of the at least one connector terminal face in a first direction;

the plurality of groups comprises a first group of parallel contact fingers and a second group of parallel contact fingers; and the insulative housing comprises:

a track elongated in a direction from a first side to a second side of the insulative housing, the track comprising:

a first lead-in portion at the first side having a first tapered surface for guiding an edge of a bus bar; and a second lead-in portion at the second side having a second tapered surface for guiding the edge of the bus bar; and a plurality of tabs, each tab adjacent to and offset in the first direction from the distal ends of a respective group of the plurality of groups of parallel contact fingers, the plurality of tabs comprising:

a first tab at the first side of the insulative housing having a tapered surface that is parallel to and aligned with the first tapered surface of the track; and a second tab at the second side of the insulative housing having a tapered surface that is parallel to and aligned with the second tapered surface of the track.

2. The power connector of claim 1, wherein the plurality of tabs are formed separately from and then coupled to the insulative housing.

3. The power connector of claim 1, wherein the plurality of tabs are positioned to block bending in the first direction of contact fingers of the respective groups of parallel contact fingers.

4. The power connector of claim 3, wherein:

the respective groups of parallel contact fingers have a rest state, and the plurality of tabs press against the distal ends of the respective groups of parallel contact fingers such that the distal ends of the contact fingers are offset in a direction opposite the first direction from their rest states, whereby the plurality of tabs pre-load the contact fingers.

5. The power connector of claim 1, wherein:

each tab of the plurality of tabs is adjacent to and offset in the first direction from the distal ends of the plurality of contact fingers of a connector terminal of the at least one connector terminals.

6. The power connector of claim 5, wherein the insulative housing comprises a plurality of tracks configured to guide the bus bar to slide relative to the at least one connector terminal.

7. The power connector of claim 6, wherein:

the plurality of tabs have distal ends contacting the distal ends of the plurality of contact fingers of the at least one connector terminal; and the contact surfaces of the plurality of contact fingers of the at least one connector terminal are offset in the first direction from the plurality of tracks; and the distal ends of the plurality of tabs are offset in a direction opposite the first direction from the plurality of tracks.

8. An electronic assembly comprising the power connector of claim 7 in combination with a substrate, wherein the power connector further comprises a plurality of tails integral with the connector terminals, wherein the plurality of tails are electrically and mechanically attached to the substrate.

9. The electronic assembly of claim 8, wherein:

each of the at least one connector terminal further comprises a first side facing the first direction and a second side facing a second direction opposite the first direction, and the plurality of contact fingers extend on the first side in the first direction, and the plurality of tails extend on the second side in the second direction.

10. The electronic assembly of claim 9, wherein each of the plurality of tracks comprises an opening, and the opening faces the plurality of contact fingers.

11. The electronic assembly of claim 10, wherein:

each of the plurality of tracks comprises a first surface parallel to the connector terminals and a second surface parallel to the first surface and offset from the first surface in the first direction, wherein the opening of each of the plurality of tracks is between the first surface and the second surface; and the contact surfaces of the plurality of contact fingers are spaced from the first surfaces of each of the plurality of tracks in a direction opposite the first direction.

12. The electronic assembly of claim 11, wherein:

the plurality of tracks are elongated in a sliding direction; and the at least one connector terminal comprises a plurality of connector terminals disposed in a first and a second row; and the first row is spaced from the second row in the sliding direction.

13. The electronic assembly of claim 12, wherein the distal ends of the plurality of contact fingers of the connector terminals in the first row extend towards the second row, and the distal ends of the plurality of contact fingers of the connector terminals in the second row extend towards the first row.

14. The electronic assembly of claim 8 further comprising a second substrate, the second substrate comprising:

a first edge slidably mounted within a first of the plurality of tracks;

a second edge slidably mounted within a second of the plurality of tracks;

a plurality of elongated conductive surfaces between the first edge and the second edge; and wherein the contact surfaces of the plurality of contact fingers contact the plurality of conductive surfaces.

15. A method of operating the electronic assembly of claim 14, the method comprising sliding the second substrate relative to the first substrate in the sliding direction.

16. A power connector, comprising:

an insulative housing;

a plurality of connector terminals held within the insulative housing, each of the plurality of connector terminals comprising:

a conductive base;

a plurality of contact fingers integral with the conductive base, wherein each of the plurality of contact fingers comprises a contact surface at a distal end; and wherein:

the contact surfaces of the plurality of contact fingers of the plurality of connector terminals face in a first direction;

the insulative housing comprises a tab adjacent to and offset in the first direction from the distal ends of at least a portion of the plurality of contact fingers;

the insulative housing comprises a plurality of tracks configured to guide a bus bar to slide relative to the plurality of connector terminals;

the plurality of tracks are elongated in a sliding direction;

the plurality of connector terminals are disposed in a first and a second row;

the first row is spaced from the second row in the sliding direction; and the plurality of contact fingers of the connector terminals in the first row are offset from the plurality of contact fingers of the second row in a direction perpendicular to the sliding direction.

17. A method for pre-loading contact fingers in a connector comprising at least one connector terminal and an insulative housing, wherein the at least one connector terminal comprises at least one conductive base and a plurality of contact fingers arranged in a plurality of groups of parallel contact fingers integral with and extending from a conductive base of the at least one conductive base, the plurality of groups of parallel contact fingers comprising a first group of parallel contact fingers and a second group of parallel contact fingers, each of the plurality of contact fingers having a contact surface and a rest state with respect to the at least one conductive base, and the insulative housing comprises a track elongated in a direction from a first side to a second side of the insulative housing, the track comprising a first lead-in portion at the first side having a first tapered surface for guiding an edge of a bus bar and a second lead-in portion at the second side for guiding the edge of the bus bar, and a plurality of tabs comprising a first tab at the first side of the insulative housing having a tapered surface that is parallel to and aligned with the first tapered surface of the track and a second tab at the second side of the insulative housing having a tapered surface that is parallel to and aligned with the second tapered surface of the track, the method comprising:

inserting the at least one connector terminal into the insulative housing such that each tab of the plurality of tabs contacts the distal ends of a respective group of the plurality of groups of parallel contact fingers;

further inserting the at least one connector terminal into the insulative housing such that the plurality of contact fingers are deflected in a direction from the rest state towards the at least one conductive base as a result of contact with the plurality of tabs; and securing the plurality of connector terminals to the insulative housing with contact surfaces of the plurality of contact fingers of the at least one connector terminal exposed through at least one opening in the insulative housing and facing in a first direction such that the plurality of contact fingers of the plurality of connector terminals are retained in a state deflected from their respective rest states.

18. The method of claim 17, wherein:

the insulative housing further comprises a plurality of tracks;

each of the plurality of tracks comprises an opening; and the openings face the plurality of contact fingers.

19. The method of claim 18, wherein:

a first of the plurality of tracks is configured to receive a first edge of the bus bar;

a second of the plurality of tracks is configured to receive a second edge of the bus bar; and contact surfaces at the distal ends of the plurality of contact fingers are configured to contact a plurality of elongated conductive surfaces between the first edge and the second edge of the bus bar.

20. A sliding power connector, comprising:

a housing comprising a track elongated in a sliding direction and configured to guide an edge of a bus bar;

a plurality of power connector terminals mounted in the housing, wherein each of the plurality of power connector terminals comprises a plurality of contact fingers, and each of the plurality of contact fingers comprises a contact surface thereon;

wherein:

at least a first power connector terminal of the plurality of power connector terminals is offset from a second power connector terminal of the plurality of power connector terminals in the sliding direction;

at least a portion of the first power connector terminal is aligned with at least a portion of the second power connector terminal in the sliding direction;

the plurality of contact fingers of the first power connector terminal are offset from the plurality of contact fingers of the second power connector terminal in a direction perpendicular to the sliding direction; and the contact surfaces of the plurality of contact fingers of the first power connector terminal are positioned to make wear tracks on a bus bar sliding in the track that are interspersed with and offset, in a direction perpendicular to the sliding direction, from wear tracks on the bus bar made by the contact surfaces of the plurality of contact fingers of the second power connector terminal.

21. The sliding power connector of claim 20, wherein the housing further comprises a tab adjacent to and offset in the first direction from the distal ends of at least a portion of the plurality of contact fingers, wherein the tab is positioned to block bending in the first direction of contact fingers of the at least the portion of the plurality of contact fingers.

22. The sliding power connector of claim 20, wherein the track is a first track, and the housing further comprises a second track, and the first track is configured to guide a first edge of the bus bar, and the second track is configured to guide a second edge of the bus bar.

23. The sliding power connector of claim 20, wherein the housing further comprises a plurality of windows exposing the plurality of power connector terminals.

24. The sliding power connector of claim 23, wherein each of the plurality of power connector terminals further comprises:

a conductive base, wherein the plurality of contact fingers extend from the conductive base in a first direction; and a plurality of tails extending from the conductive base in a second direction opposite the first direction, wherein the plurality of tails are configured for electrically and mechanically connecting to a first substrate.

25. The sliding power connector of claim 24, wherein a first group of the plurality of windows expose the plurality of contact fingers of the plurality of power_connector terminals, and wherein a second group of the plurality of windows expose the plurality of tails of the plurality of power connector terminals.

26. The sliding power connector of claim 20, wherein at least a portion of at least one of the plurality of contact fingers of the first power connector terminal is aligned with at least a portion of at least one of the plurality of contact fingers of the second power connector terminal in the sliding direction.

27. The sliding power connector of claim 26, wherein the plurality of contact fingers of the first power connector terminal are offset from the plurality of contact fingers of the second power connector terminal by one-half a width of the plurality of contact fingers of the first power connector terminal, or by one-half a width of the plurality of contact fingers of the second power connector terminal, in the direction perpendicular to the sliding direction.

* * * * *